US011448385B1

(12) United States Patent
Chokshi et al.

(10) Patent No.: US 11,448,385 B1
(45) Date of Patent: Sep. 20, 2022

(54) ROTATABLE LIGHT FIXTURE MOUNT SYSTEM

(71) Applicant: ABL IP Holding LLC, Atlanta, GA (US)

(72) Inventors: Sparsh Chokshi, Duluth, GA (US); Jeremy Andrew Stone, Atlanta, GA (US); Kaitlyn T. Crawford, Atlanta, GA (US); Kristen A. Aceto-Netemeyer, Decatur, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 17/335,428

(22) Filed: Jun. 1, 2021

(51) Int. Cl.
*F21V 21/30* (2006.01)
*F21V 23/06* (2006.01)

(52) U.S. Cl.
CPC ..... *F21V 21/30* (2013.01); *F21V 23/06* (2013.01)

(58) Field of Classification Search
CPC ..... F21V 23/06; F21V 23/001; F21V 21/30; F21V 31/005; F21V 29/70; F21Y 2115/10
See application file for complete search history.

(56) References Cited

U.S. PATENT DOCUMENTS

| | | | | |
|---|---|---|---|---|
| 969,220 | A | 9/1910 | Taylor | |
| 10,001,265 | B1 | 6/2018 | Newton | |
| 10,086,750 | B2 | 10/2018 | Paine et al. | |
| 10,525,872 | B2 * | 1/2020 | Marchese | B60Q 1/18 |
| 2003/0007355 | A1 | 1/2003 | Leen | |
| 2014/0328070 | A1 | 11/2014 | Oquendo, Jr. et al. | |

FOREIGN PATENT DOCUMENTS

| | | |
|---|---|---|
| EP | 0710796 | 12/1998 |
| EP | 1674790 | 6/2006 |

* cited by examiner

*Primary Examiner* — Anabel Ton
(74) *Attorney, Agent, or Firm* — Kilpatrick Townsend & Stockton LLP

(57) ABSTRACT

A rotatable connection for securing a light module to a supporting structure is described herein. The light module directs light towards an illumination area. The light module is directable by rotating the light module using the rotatable connection. The rotatable connection includes an upper connector and a base. The upper connector and the base may secure together with a tool-less connection. the upper connector couples to the light module through a rotatable connection that enables rotation of the light module without use of tools and also resists rotation of the light module after the light module has been installed at a particular angle.

26 Claims, 8 Drawing Sheets

FIG. 7
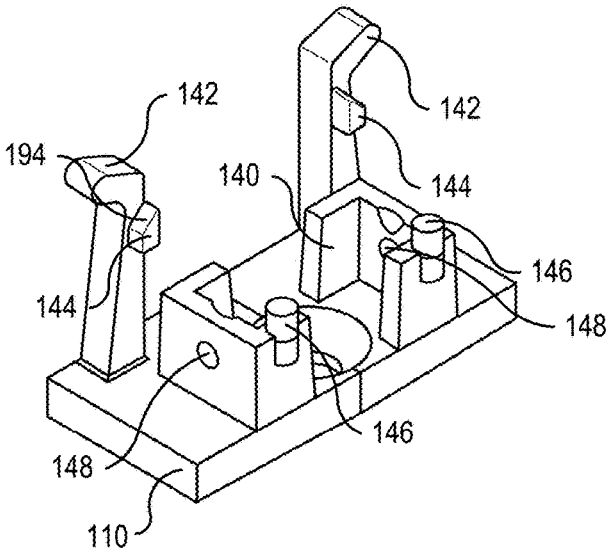
FIG. 8
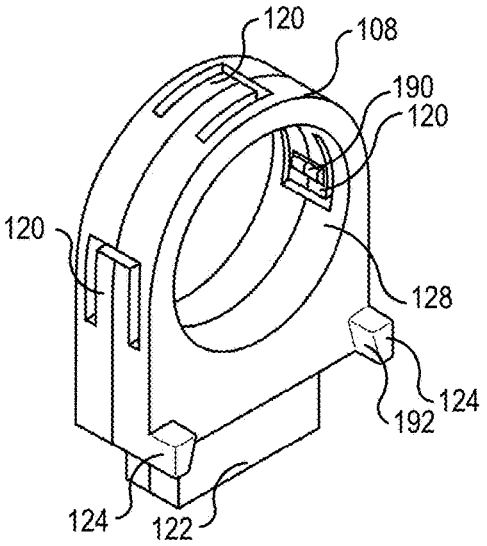
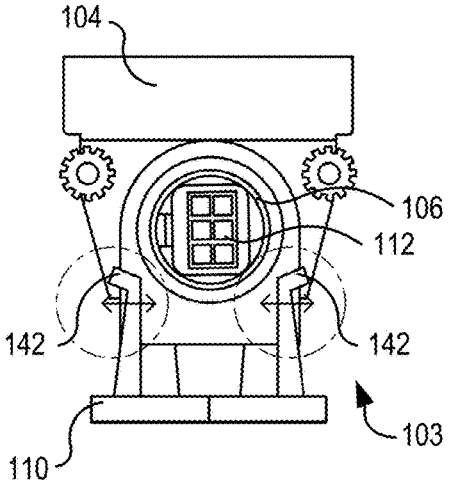
FIG. 9A
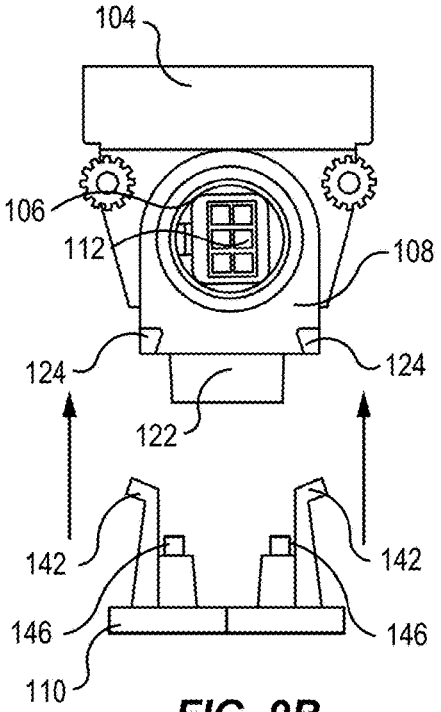
FIG. 9B

FIG. 13
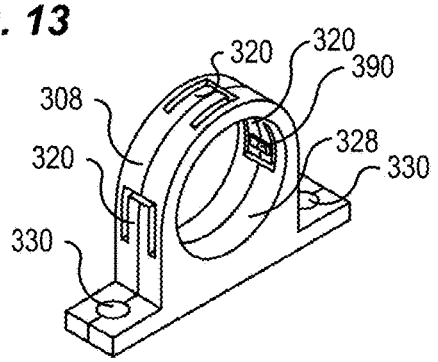
FIG. 14
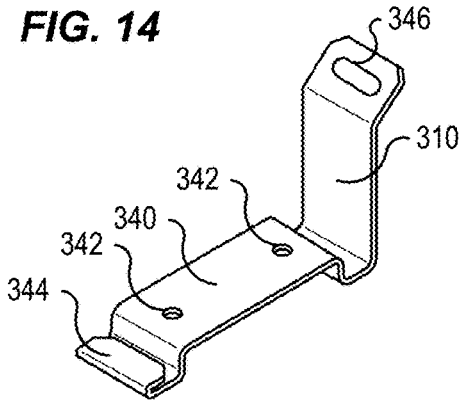
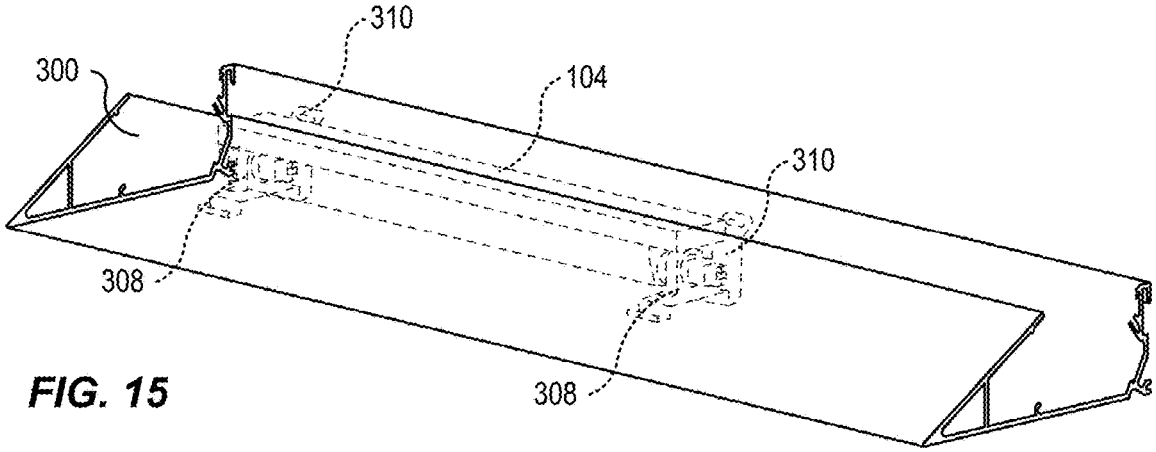
FIG. 15
FIG. 16
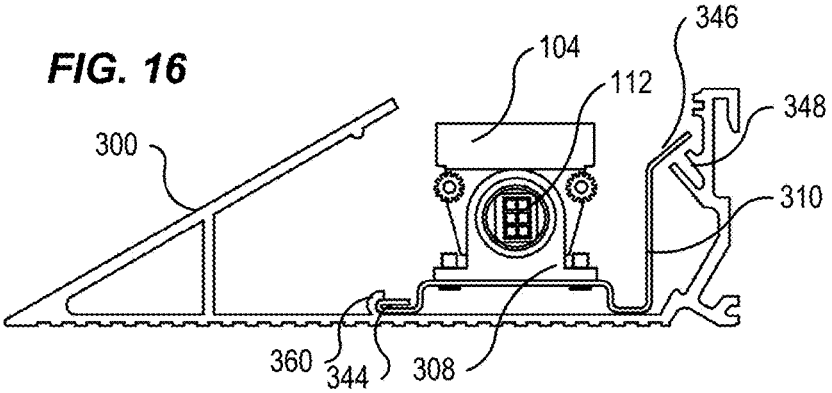

ROTATABLE LIGHT FIXTURE MOUNT SYSTEM

BACKGROUND

Some light fixtures are designed for mounting on a surface or structure such as a wall, architectural extrusion, or other such supporting surface. Such light fixtures may, in some examples, be attached through one or more fasteners that extend through a back wall of a housing of the light fixture. With some light fixtures, once the light fixture is attached to the wall, adjustment of the direction of light emitted from the light fixture is generally not possible.

One shortcoming with previous light fixture mounting systems is that a particular mounting assembly may be designed to fit only one type of mounting structure and may require particular sets of tools to install and may not be adjustable, such as with respect to adjustment of the direction of the emitted light, without the use of tools to loosen the mounting structure, adjust a position, and re-tighten the mounting structure.

Another shortcoming with the existing mounting systems is that they typically require several different tools and a considerable amount of work and time to complete the installation. The installation procedure for such light fixtures may be difficult because the light fixtures are typically installed on an existing structure which means the light fixture must be attached or installed at elevation, such as atop a ladder, while also handling installation tools which increases the complexity of the installation.

BRIEF SUMMARY

Embodiments of the invention covered by this patent are defined by the claims below, not this summary. This summary is a high-level overview of various aspects and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings, and each claim.

One general aspect includes a rotatable light fixture. The light fixture includes a light module including a light source adapted to emit light generated by the light source, the light module including an electrical connection to receive electrical power for the light source. The light fixture also includes a rotatable mount. The rotatable mount includes a light fixture connector adapted to couple to the light module at a first end of the light module, the light fixture connector having a cylindrical shape with a plurality of recesses arranged around an outer perimeter of the cylindrical shape. The rotatable mount also includes an upper connector defining a circular opening adapted to receive the cylindrical shape of the light fixture connector, with the upper connector further including a protrusion that extends into the circular opening and that is adapted to engage with one of the plurality of recesses on the light fixture connector. The rotatable mount also includes a base connector adapted to releasably couple with the upper connector to secure the upper connector to a supporting structure.

Another general aspect includes a light fixture with a light module having a light source adapted to emit light generated by the light source, the light module including an electrical connection to receive electrical power for the light source.

The light fixture also includes a rotatable mount with a light fixture connector adapted to couple to the light module at a first end of the light module, the light fixture connector having a cylindrical shape with a plurality of recesses arranged around an outer perimeter of the cylindrical shape. The rotatable mount also includes an upper connector defining a circular opening adapted to receive the cylindrical shape of the light fixture connector, the upper connector further including a protrusion that extends into the circular opening that is adapted to engage with one of the plurality of recesses on the light fixture connector. The rotatable mount also includes a base connector adapted to couple to a supporting structure, the upper connector adapted to couple to the base connector.

Another general aspect includes a rotatable mount for a fixture. The rotatable mount includes a fixture connector having a cylindrical shape with a plurality of recesses arranged around an outer perimeter of the cylindrical shape, the fixture connector adapted to couple to an end of the fixture and enable an electrical connection to the fixture through a center of the cylindrical shape. The rotatable mount also includes an upper connector defining a circular opening adapted to receive the cylindrical shape of the fixture connector, the upper connector further comprising a protrusion that extends into the circular opening and that is adapted to engage with one of the plurality of recesses on the fixture connector. The rotatable mount also includes a base connector adapted to releasably couple with the upper connector to secure the upper connector to a supporting structure.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among similar components. If only the first reference label is used in the specification, the description is applicable to any one of the similar components having the same first reference label irrespective of the second reference label.

FIG. 7 shows a perspective view of a base connector of the rotatable light mount, according to some embodiments.

FIG. 8 shows a perspective view of an upper connector of the rotatable light mount, according to some embodiments.

FIGS. 9A-9B show an end view of the light module of FIG. 1 with the base connector and upper connector releasably connecting, according to some embodiments.

FIG. 13 shows a perspective view of an upper connector of a rotatable light mount, according to some embodiments.

FIG. 14 shows a perspective view of a base connector of a rotatable light mount for connecting to architectural extrusions, according to some embodiments.

FIG. 15 shows a rotatable light mount fitted within an architectural extrusion, according to some embodiments.

FIG. 16 shows an end view of the rotatable light mount fitted within the architectural extrusion, according to some embodiments.

DETAILED DESCRIPTION

Figure 1:
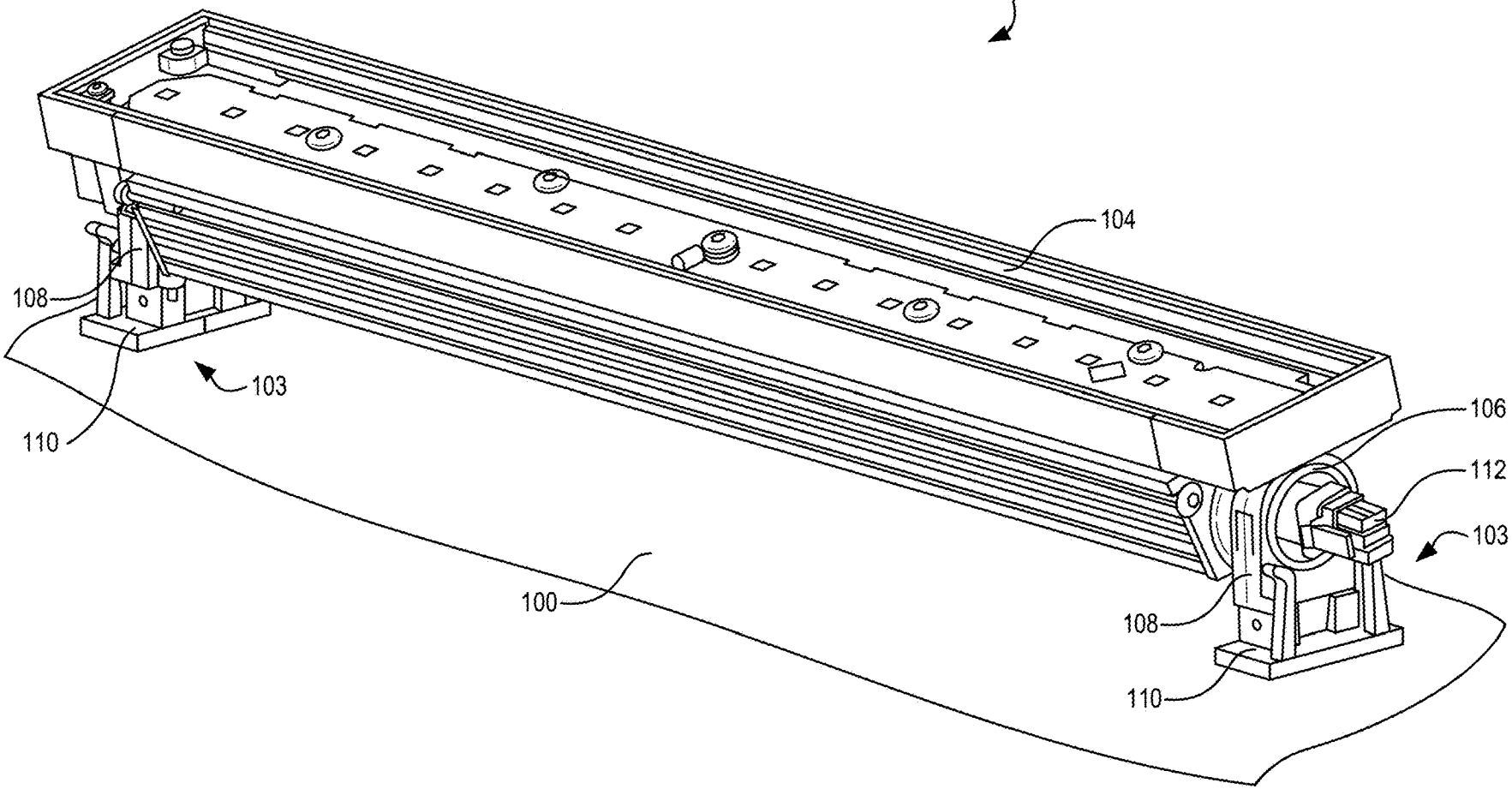
FIG. 1 illustrates a top perspective view of a rotatable light fixture mount connecting a light module to a supporting surface, according to some embodiments.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the interest of clarity, not all of the routine features of the examples described herein are shown and described. It will, of course, be appreciated that in the development of any such actual implementation, numerous implementation-specific decisions need to be made in order to achieve the developer's specific goals, such as compliance with application- and business-related constraints, and that these specific goals will vary from one implementation to another and from one developer to another.

Embodiments described herein include a light fixture mount system that enables rotation of the light fixture, tool-less removal and re-installation of the light fixture to the mounts, and adjustability of the direction of the light before, during, and after installation of the light fixture without requiring tools for removal of the entire light fixture. The light fixture and mounting system described herein provides for ease of adjustment and fine-tuning of light direction from a light module of the light fixture without the need to use tools for angle adjustment. The light fixtures and mounting systems described herein provide for visual and audible clues to aid in installation in addition to the tool-less installation and adjustment mentioned above. Each of these benefits and advantages over traditional systems enable the light fixtures provided herein to be useful for many applications including architectural lighting, home lighting, outdoor lighting, industrial applications, and other such lighting environments. The ease of adjustability and the ability to install, remove, and adjust without tools provides for simplified maintenance, such as to replace light modules or elements such as bulbs, and adjustment to achieve a desired light direction and position without the need for multiple individuals to handle, support, angle, and tighten traditional rotatable light fixture systems.

Embodiments of the present disclosure are directed to, among other things, a rotatable light fixture that can be rotated after installation without the use of tools. The light fixtures can also be removed from and secured to supporting structures without the use of tools. The light fixture also enables great flexibility and range of rotation, for example enables rotation of the light fixture three hundred and sixty degrees when unmounted and up to or in excess of one hundred and eighty degrees when mounted to a supporting structure, such as a wall. In some examples, the light fixture may be a light that is attached to a structure such as a wall, post, extrusion, or other such supporting structure. The light may be directed towards an illumination area to ensure proper or desired lighting of the illumination area. In traditional systems, the light fixture may be mounted to the supporting structure and subsequently adjusted to direct light towards the illumination area, and subsequently locked in place with mechanical connectors to prevent further rotation of the light fixture. The light fixture described herein may be easily installed by first connecting a base connector to the mounting structure and subsequently coupling an upper connector to the base connector, the upper connector coupled to a light module. The light fixture may then be rotated by twisting the light module relative to the base connector. Positive engagement provided by a flex spring within the upper connector enables rotation of the light module while also resisting rotation, to ensure the light module remains directed in the desired direction without the need for additional tools and mechanical connectors to secure the rotatable connection.

Figure 2:
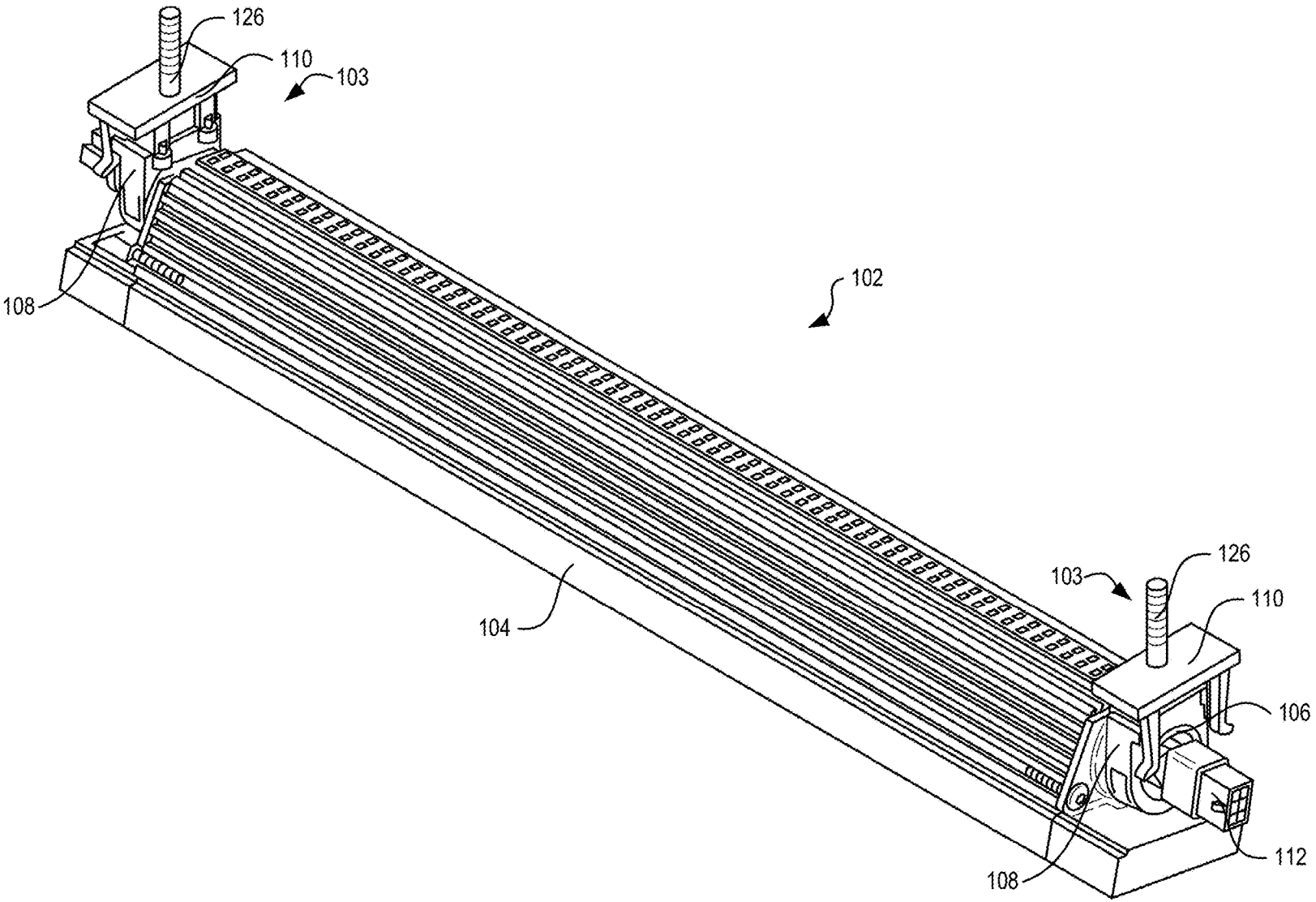
FIG. 2 shows a bottom perspective view of the rotatable light fixture mount and light module of FIG. 1, according to some embodiments.

Turning now to the figures, FIGS. 1 and 2 illustrate a top and bottom perspective view of a light fixture 102 connected to a supporting structure 100 through rotatable mounts 103, according to some embodiments. The light fixture 102 includes a light module 104 that produces light and directs light towards an illumination area. The light module 104 may include one or more light producing elements such as incandescent bulbs, light emitting diodes, halogen bulbs, fluorescent bulbs, or other such light producing elements. The light module 104 is depicted having a rectangular shape, though other shapes and configurations of light modules are envisioned and intended to be covered by this disclosure.

The light module 104 includes an electrical connection 112 through which power and control of the light module 104 are provided. The electrical connection 112 is shown protruding through an upper connector 108 of the rotatable mount 103. In some examples, the electrical connection 112 may be at each end of the light module 104, such that light modules 104 may be strung together in a chain. The position of the electrical connection 112 within the upper connector 108 enables the light module 104 to rotate about the electrical connection 112, such that the electrical connection 112 is relatively stationary and unaffected by rotations of the light module 104.

The light module 104 is coupled to a supporting structure 100 through rotatable mounts 103. The rotatable mounts 103 and the light module 104 form the light fixture 102. The supporting structure 100 may be a wall, pole, beam, ceiling, architectural component, or other such structure to which a light fixture may be mounted to provide illumination to a particular area.

The rotatable mounts 103 are coupled to the ends of the light module 104 and provide releasable coupling between the support structure 100 and the light module 104. The rotatable mounts 103 also enable rotation of the light module 104 relative to the support structure 100 such that the light produced by the light module 104 may be directed towards a particular area or in a particular direction. The rotatable mounts 103, in addition to enabling rotation of the light module 104, also enable removal and installation of the light fixture 102 by separating an upper connector 108 and a base connector 110 of the rotatable mount 103. Further details of the rotatable mounts 103 are provided with respect to FIGS. 3-9, and additional embodiments of rotatable mounts (shown and described with respect to FIGS. 10-16) may also be used to connect the light module 104 to the supporting structure 100. The axis of rotation is centered within a light fixture connector 106 that is affixed to the end of the light module 104 and to which the upper connector 108 attaches. The interface between the light fixture connector 106 and the upper connector 108 is a rotatable connection, and is shown and described in further detail in FIGS. 3-5.

The base connector 110 is shown connected to the supporting structure 100 via a threaded connection 126, which may include an anchor, screw, bolt, or other such connection. In some examples, the base connector 110 may otherwise be affixed to the supporting structure 100, for example through the use of adhesives, semi-permanent connections, permanent connections, rivets, welding, or any other suitable connections means.

Figure 3B:
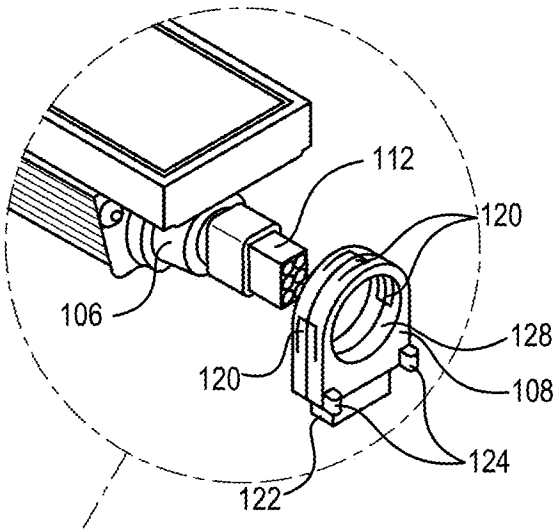
FIG. 3B shows a detail view of a rotatable light mount connecting to an end of the light module of FIG. 3A, according to some embodiments.
Figure 3A:
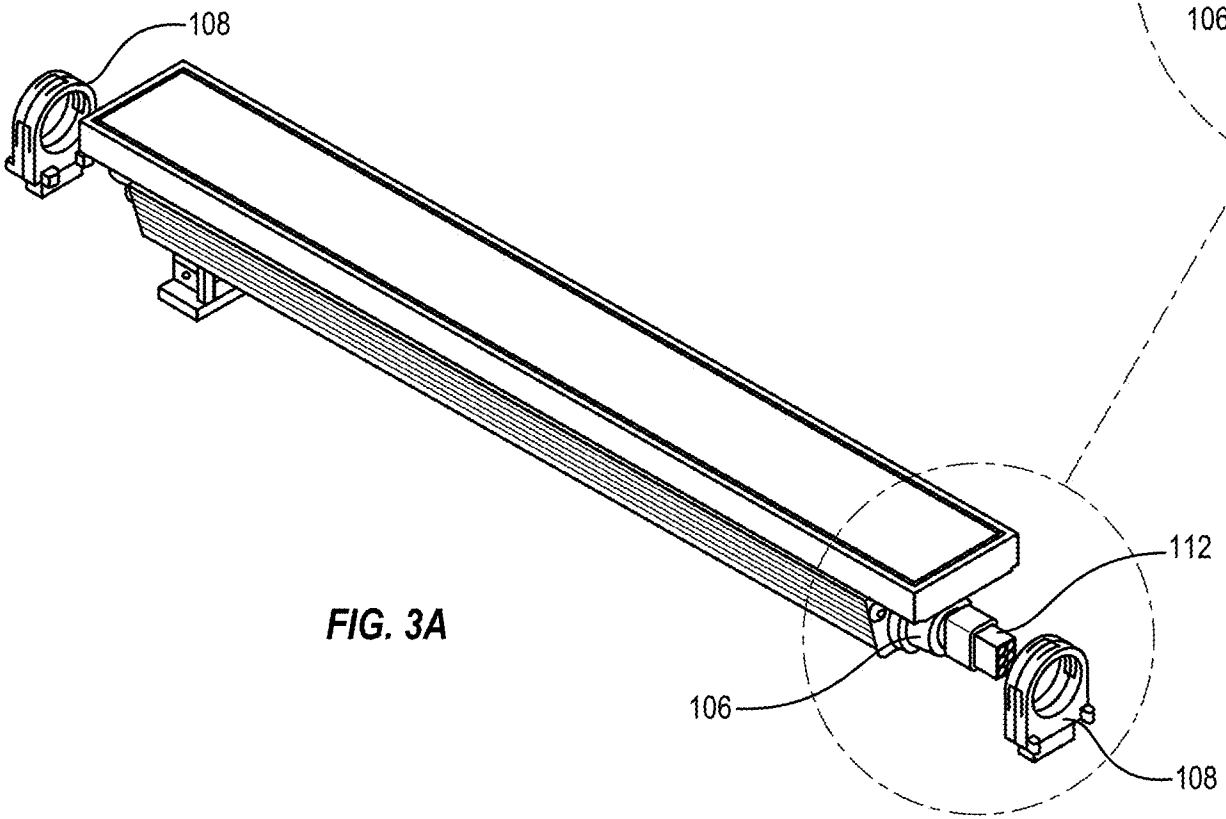
FIG. 3A shows a perspective view of a light module having a rotatable mount coupleable to an end thereof, according to some embodiments.

FIGS. 3A and 3B show a perspective view and a detail view of a light module 104 having an upper connector 108 of a rotatable mount 103 coupled to an end thereof, according to some embodiments. The light module 104 is shown with the light fixture connector 106 shown as a cylindrical connector that fits within a circular opening of the upper connector 108. The upper connector 108 includes an aperture 128 that receives the light fixture connector 106, and the interface between the upper connector 108 and the light fixture connector 106 enables selective rotation of the light module 104 relative to the upper connector 108. The center of aperture 128 defines the axis of rotation x for the light module 104. The selective rotation may be enabled by a frictional coupling between the light fixture connector 106 and the upper connector 108. The frictional coupling may enable rotation while also resisting free movement or rotation of the light module 104. In some examples, the light fixture connector 106 may include a plurality of recesses around a periphery of the cylinder defining the light fixture connector 106. The plurality of recesses may engage with one or more protrusions on the inner perimeter of the opening in the upper connector 108. The details of such a structure with a protrusion and recesses enabling rotational engagement of the light module 104 with respect to the upper connector 108 are shown and described further with respect to FIGS. 4, 5, and 8 below. The upper connector 108 fits over the electrical connection 112 and onto the cylindrical body of the light fixture connector 106. The upper connector 108 may be, but does not have to be, installed onto the light module 104 prior to installation on the supporting structure 100.

Figure 4:
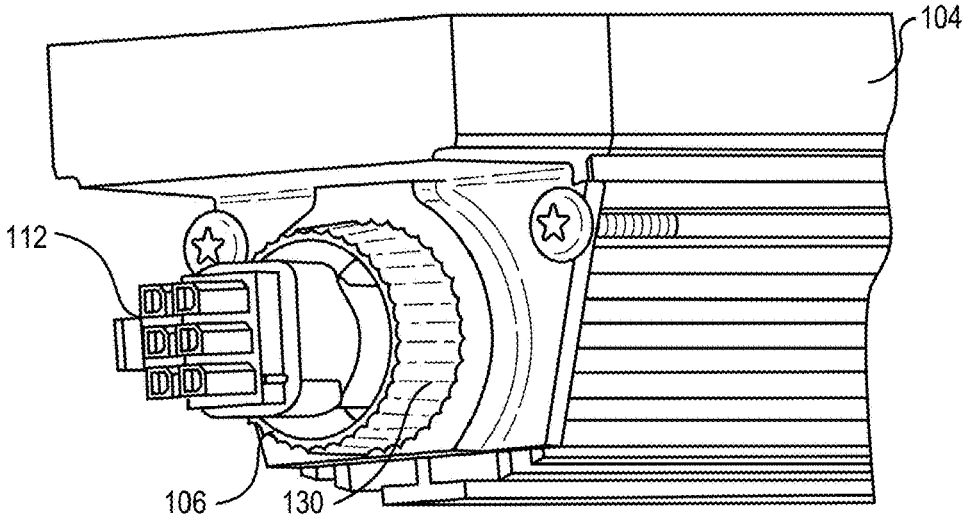
FIG. 4 shows an end view of the light module of FIG. 1 that connects to the rotatable light mount, according to some embodiments.

FIG. 4 shows an end view of the light module 104 of FIG. 1 that connects to the rotatable mount 103, according to some embodiments. The light fixture connector 106 is shown as a relatively thin-walled cylindrical connector, onto which the upper connector 108 slides. The light fixture connector 106 surrounds the electrical connection 112. The outer surface of the light fixture connector 106 can include a plurality of grooves or recesses 130 arranged around the outer perimeter. As explained in more detail below, one or more protrusions 190 may be provided on the inner surface of the upper connector 108 that defines aperture 128. The protrusion(s) 190 seat in the recesses 130 to retain the rotational orientation of the light module 104. There may be thirty-six recesses 130 around the light fixture connector 106 such that the light module 104 may rotate in ten degree increments. In some examples there may be more than or less than thirty-six recesses, for example, there may be eighteen or seventy-two recesses.

Figure 5:
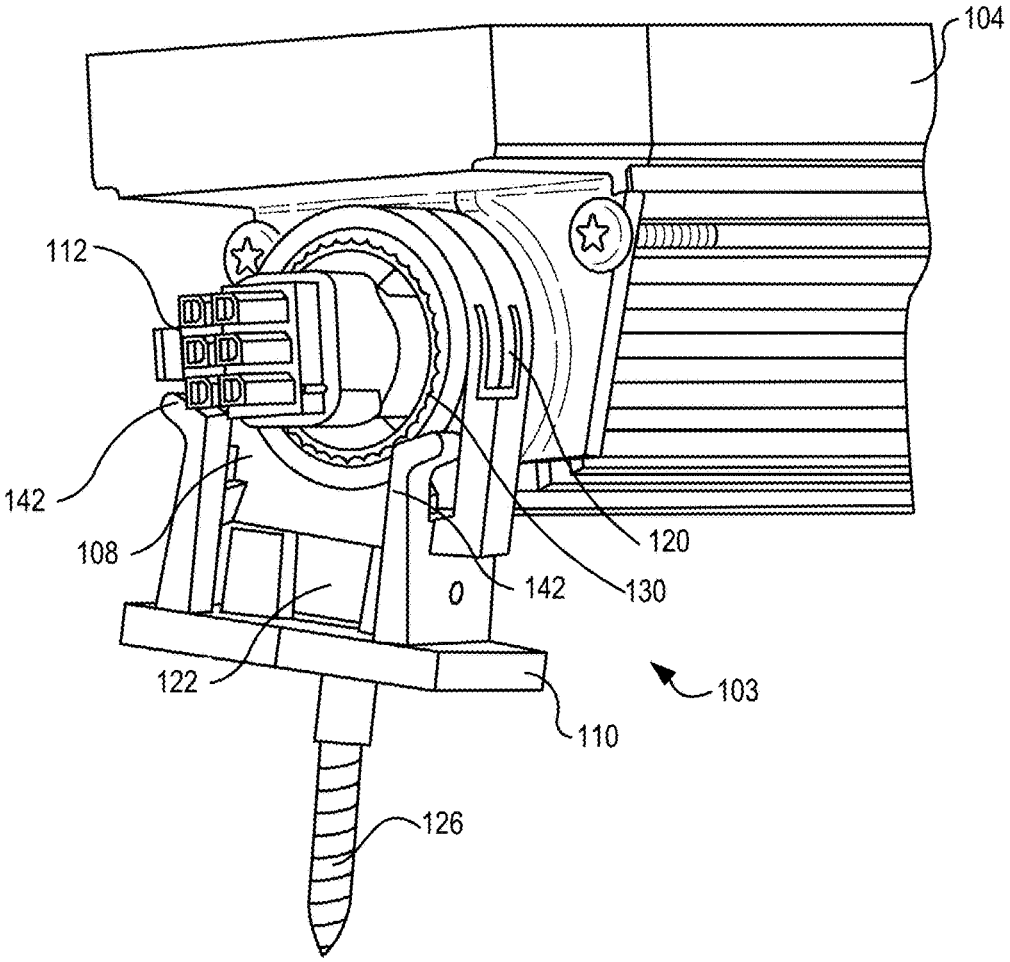
FIG. 5 shows an end view of the light module of FIG. 1 with the rotatable light mount connected, according to some embodiments.

FIG. 5 shows an end view of the light module 104 of FIG. 1 with the rotatable mount 103 connected, according to some embodiments. The rotatable mount 103, including the upper connector 108 and the base connector 110, is connected to the light fixture connector 106 on each end of the light module 104. The upper connector 108 includes flanges 120 that include the protrusions 190 (shown in FIG. 8) to engage recesses 130. Any number of flanges 120 may be provided. The flanges 120 flex outwardly to permit the protrusions 190 to disengage from the recesses 130 during rotation of the light module 104. Moreover, engagement of the protrusions 190 with recesses 130 help to retain the rotational orientation of the light module 104 after the desired angle is set.

Figures 6A, 6B, 6C:
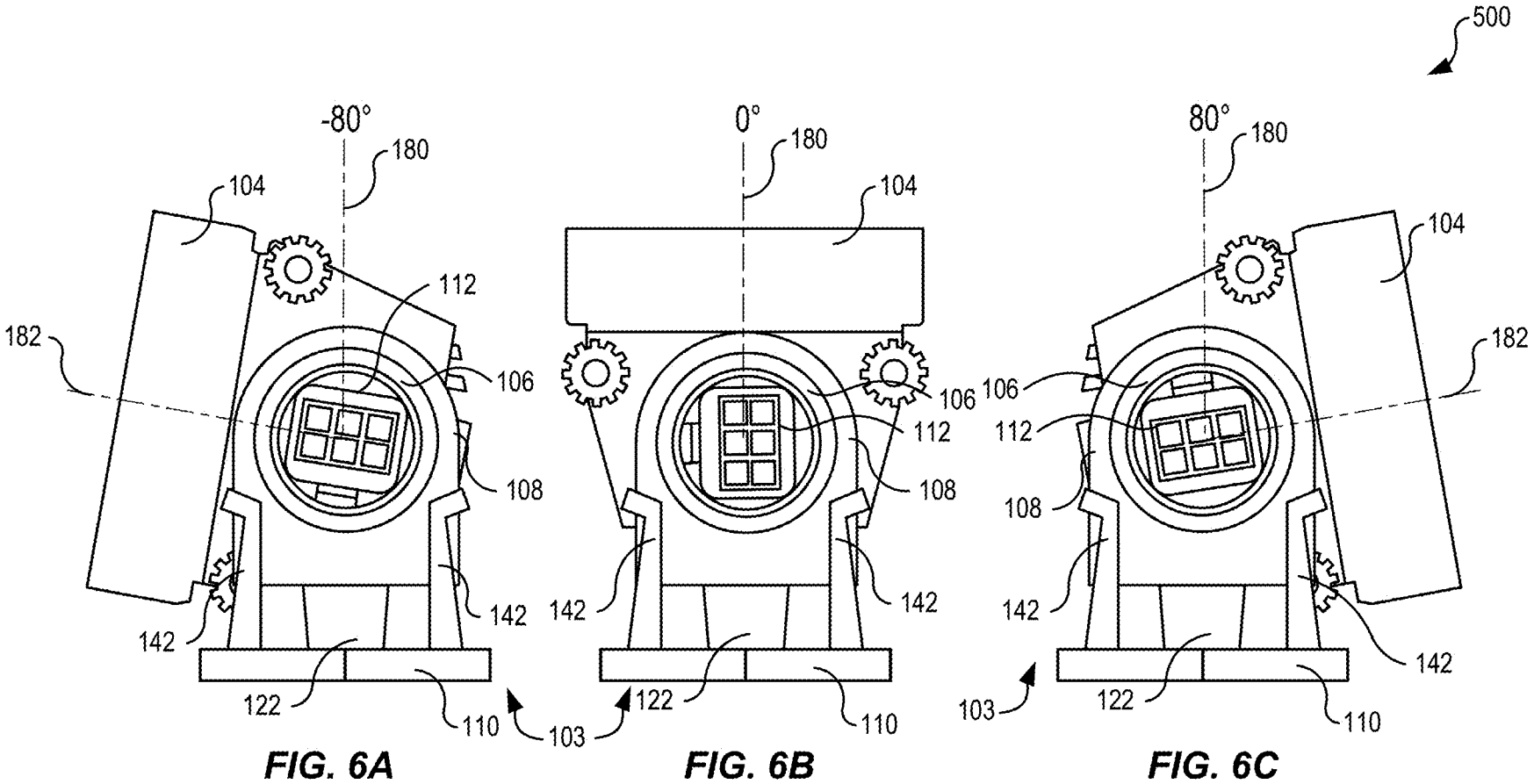
FIGS. 6A-6C show an end view of the light module of FIG. 1 as the light module rotates through a range of rotation, according to some embodiments.

FIGS. 6A-6C show an end view of the light module of FIG. 1 as the light module 104 rotates through a range of rotation, according to some embodiments. The range of rotation is defined in FIGS. 6A-6C from an axis 180 extending perpendicular to the supporting surface to an axis 182 extending perpendicular to the axis of the light module 104. The light module 104 is shown rotating through a range of motion of one hundred and sixty degrees in FIGS. 6A-6C (eighty degrees on each side of axis 180), though other angular rotations are possible. For example, with higher rotatable mounts 103 or thinner light modules 104, the angle of rotation may be up to one hundred and eighty degrees when the light module 104 is mounted. When unmounted, the light module 104 may rotate through a range of three hundred and sixty degrees.

The upper connector 108 and the base connector 110 are selectively coupleable, as shown and described with respect to FIGS. 7-9B. FIG. 7 shows a perspective view of the base connector 110 of the rotatable mount 103, according to some embodiments. The base connector 110 includes a set of walls 152 that define a socket 140 to receive a base 122 of the upper connector 108. While two walls 152 are shown as forming the socket 140, fewer (i.e., a single wall) or more walls could be used. Recesses 148 are defined in the walls 152 to receive detents 154 located on the sides of the base 122 of the upper connector 108. The recesses 148 may be passages that pass entirely through the wall 152 or may be a recess that extends partway through the thickness of the wall 152. The detents may assist in alignment and retention of the base 122 into the socket 140. The socket 140 also includes alignment pins 146 that aid in alignment of the upper connector 108 and the base connector 110 and ensure that the upper connector 108 and base connector 110 are properly oriented to enable the retention features on each to engage. The alignment pins 146 fit into recesses 156 on the upper connector 108 and therefore only allow the upper connector and base connector 110 to fit together in a single orientation.

The base connector 110 includes two arms 142 that include retention features to engage and secure the upper connector 108 and base connectors 110 together. The arms 142 extend from the base connector 110. The arms 142 may be formed of a flexible and/or semi-rigid material such as a plastic or pliable metal or other such material. The arms 142 each include base locking protrusions 144 that serve as locking lugs to secure the upper connector 108 to the base connector 110. The base locking protrusions 144 include an upper angled surface 194 and a lower locking surface 196.

FIG. 8 shows a perspective view of an upper connector 108 of the rotatable mount 103, according to some embodiments. The upper connector 108 includes a base 122 that fits within the socket 140 of the base connector 110 and has a shape corresponding to the shape of the socket 140. The upper connector 108 also includes upper locking protrusions 124 with lower angled surfaces 192 and an upper locking surface 198.

The angled surfaces 192 on upper locking protrusions 124 contact the angled surfaces 194 on base locking protrusions 144, causing the arms 142 to flex inwards. The inward flexing of the arms 142 enables the base locking protrusions 144 and the upper locking protrusions 124 to slide past one another, after which the arms 142 return to their equilibrium state such that the upper locking surfaces 198 and lower locking surfaces 196 abut to help lock the connectors 108, 110 together.

FIGS. 9A-9B show an end view of the light module 104 of FIG. 1 with the base connector 110 and upper connector 108 releasably connecting, according to some embodiments. As described above, the arms 142 flex inwards during insertion of the upper connector 108 (as indicated by the arrows of FIG. 9A). When the arms 142 are in an unflexed state, the base locking protrusions 144 and upper locking protrusions 124 abut to resist removal of the upper connector 108. As depicted in FIG. 9B, the arms 142 may be pressed inwards by an installer, thereby releasing contact between the locking protrusions 144, 124 so as to enable the upper connector 108 to be removed from the base connector 110. In this manner, the installation of the light module 104 and the upper connector 108 into the base connector 110 may be tool-less and not require any more than a user to pinch the arms 142 together to release the upper connector 108 from the base connector 110.

Figure 10:
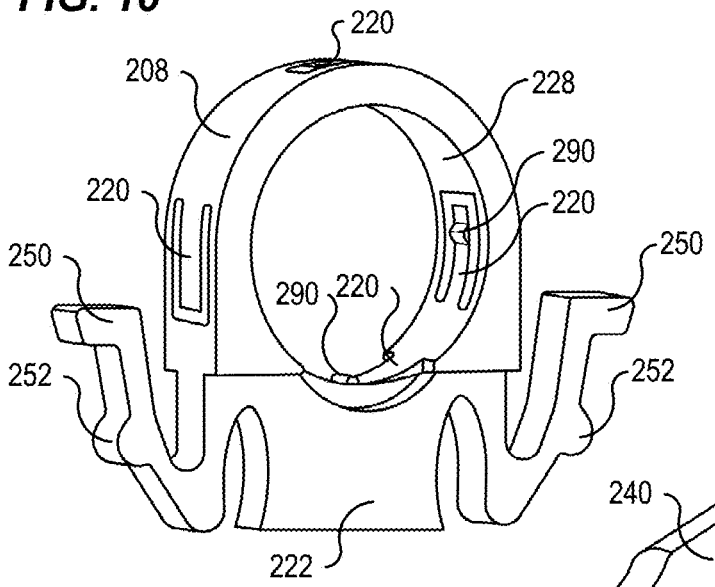
FIG. 10 shows a perspective view of an upper connector of a rotatable light mount, according to some embodiments.

FIG. 10 shows a perspective view of an upper connector 208 of a rotatable light fixture, according to some embodiments. The upper connector 208 and the base connector 210 of FIG. 11 may be alternative examples of the upper connector 108 and the base connector 110 described above. As such, the upper connector 208 and the base connector 210 may be used with the light modules 104 in the same manner as the upper connector 108 and the base connector 110 described above. The upper connector 208 includes a cylindrical passage 228 into which protrusions 290 extend to engage with the recesses 130 of the light fixture connector 106. The protrusions 290 are connected to flanges 220 that enable the protrusions 290 to engage and disengage with recesses 130. The upper connector 208 also includes a base 222 that inserts into a socket 240 of the base connector 210.

The upper connector 208 includes arms 250 that flex inwards and outwards to selectively engage protrusions 252 with recesses 242 of the socket 240 to secure the upper connector 208 and the base connector 210 together. The upper connector 208 and the base connector 210 engage and release by flexing the arms 250 in a similar manner to the arms 142. The protrusions 252 are shown having a bump or semi-circular shape in FIG. 10, though other shapes, configurations, and arrangements of protrusions may extend from the arms 250 in some examples. For example, the protrusions 252 may include triangular, pyramidal, hook-shaped, cylindrical, or other such shapes of protrusions 252.

Figure 11:
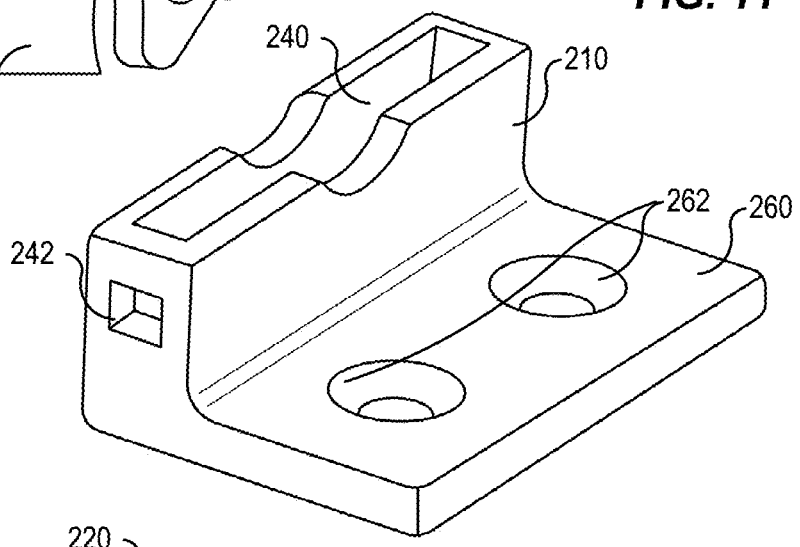
FIG. 11 shows a perspective view of a base connector of a rotatable light mount for connecting with the upper connector of FIG. 10, according to some embodiments.

FIG. 11 shows a perspective view of a base connector 210 of a rotatable light mount for connecting with the upper connector 208 of FIG. 10, according to some embodiments. The base connector 210 includes a socket 240 to receive the base 222 of the upper connector 208. The base connector 210 has a flange 260 with holes 262 for securing the base connector 210 to a supporting structure 100. The base connector 210 also defines a recess 242 that the protrusions 252 fit into when the upper connector 208 and base connector 210 are brought together.

Figure 12:
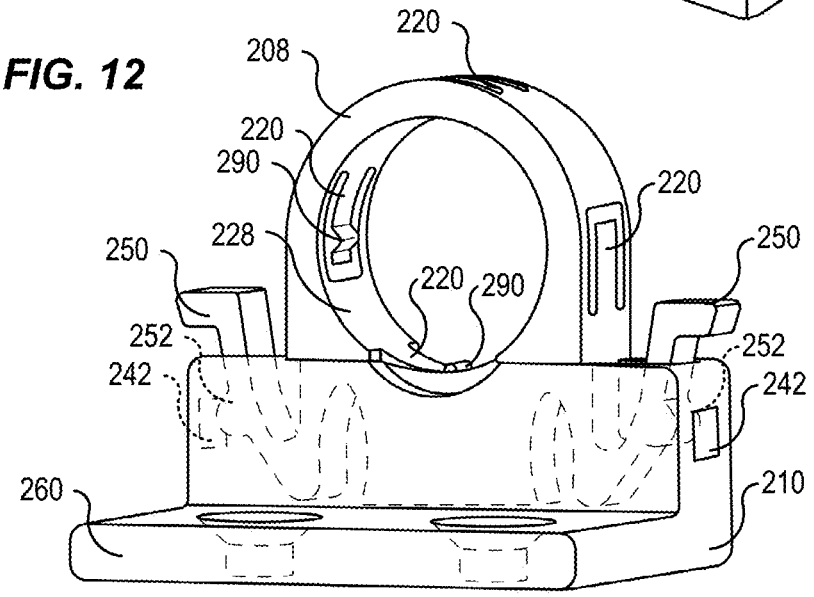
FIG. 12 shows a perspective view of a rotatable light mount including the base connector and upper connector of FIGS. 10 and 11, according to some embodiments.

FIG. 12 shows a perspective view of a rotatable light mount including the base connector 210 and upper connector 208 of FIGS. 10 and 11, according to some embodiments. The protrusions 252 are shown extending into the recesses 242 to lock the connectors together. By squeezing the arms 250 together, the protrusions 252 are released from the recesses 242 and the upper connector 208 can be removed from the base connector 210.

FIG. 13 shows a perspective view of an upper connector 308 of a rotatable light mount, according to some embodiments. The upper connector 308 may be used in place of the upper connectors 108 and 208 to mount the light module 104 to a supporting structure. The upper connector 308 includes protrusions 390 on flanges 320 to engage with recesses 130. The upper connector also includes holes 330 through which a threaded connector or other connector may be driven to couple the upper connector 308 to the base connector 310. In some examples, the holes 330 may be used for mounting the upper connector 308 to a supporting structure, for example as a static wall mount affixed with screws to a wall or other such structure. In such examples, the upper connector 308 may be used without a base connector 310.

FIG. 14 shows a perspective view of a base connector 310 of a rotatable light mount for connecting to architectural extrusions 300, according to some embodiments. The base connector 310 may be used to affix the light module 104 to an architectural extrusion or other supporting structure 100. The base connector 310 includes a flange 344 to fit into a groove or channel 360 of an architectural extrusion 300. The base connector 310 includes a base 340 in which holes 342 are defined through which a connector, such as a threaded connector, may be affixed to secure the upper connector 308 to the base connector 310. The holes 342 may be used with any suitable fastener system, such as rivets, posts, studs, and other such connectors or fastener systems. The base connector 310 also includes a slot or opening 346 through which a threaded connector may be used to secure the base connector 310 to an architectural extrusion (such as supporting structure 100).

FIGS. 15-16 show a light module 104 fitted with a rotatable connector including upper connector 308 and base connector 310 within an architectural extrusion 300, according to some embodiments. The light module 104 is connected to the extrusion through the use of the rotatable mount, such that the light module 104 is directed in any suitable direction, to achieve a desired light direction or effect through the use of the light module 104. The base connectors 310 may be slid along a length of the architectural extrusion to adjust a lateral position of the light module 104 within the architectural extrusion 300. The base connectors 310 are secured to the architectural extrusion 300 via the flange 344 that secures to the channel 360 at a first end of the base connector 310 while a second end of the base connector 310 is secured by passing a threaded connector through slot 346 and into threaded engagement 348.

While the present subject matter has been described in detail with respect to specific aspects thereof, it will be appreciated that those skilled in the art, upon attaining an understanding of the foregoing, may readily produce alterations to, variations of, and equivalents to such aspects. Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter. Accordingly, the present disclosure has been presented for purposes of example rather than limitation, and does not preclude the inclusion of such modifications, variations, and/or additions to the present subject matter as would be readily apparent to one of ordinary skill in the art. It will be apparent to those skilled in the art that various modifications and variations can be made in the method and system of the present invention without departing from the spirit or scope of the invention. Thus, it is intended that the present invention include modifications and variations that are within the scope of the appended claims and their equivalents. It is to be understood that any workable combination of the features and capabilities disclosed herein is also considered to be disclosed.

What is claimed is:

1. A light fixture comprising:

a light module comprising a light source adapted to emit light generated by the light source, the light module comprising an electrical connection to receive electrical power for the light source;

a rotatable mount comprising:

a light fixture connector adapted to couple to the light module at a first end of the light module, the light fixture connector having a cylindrical shape with a plurality of recesses arranged around an outer perimeter of the cylindrical shape;

an upper connector defining a circular opening adapted to receive the cylindrical shape of the light fixture connector, the upper connector further comprising a protrusion that extends into the circular opening and that is adapted to engage with one of the plurality of recesses on the light fixture connector, the light fixture connector and the upper connector being adapted to rotate relative to each other through a range of rotation of at least one hundred and sixty degrees; and a base connector adapted to releasably couple with the upper connector to secure the upper connector to a supporting structure.

2. The light fixture of claim 1, wherein the base connector comprises a socket to receive a protrusion extending from an end of the upper connector when the base connector and the upper connector are coupled together.

3. The light fixture of claim 1, wherein the upper connector comprises a first protrusion having a first angled surface and the base connector comprises a flexible arm having a second protrusion with a second angled surface, the first angled surface and the second angled surface configured to engage and flex the flexible arm as the upper connector and the base connector are coupled together, wherein the flexible arm is configured to return to an equilibrium state when the upper connector is fully coupled with the base connector.

4. The light fixture of claim 3, wherein the first protrusion of the upper connector comprises a first locking surface and the second protrusion of the flexible arm comprises a second locking surface such that, when the upper connector and the base connector are fully coupled together, the first locking surface abuts the second locking surface.

5. The light fixture of claim 4, wherein the flexible arm is a first flexible arm and the base connector further comprises a second flexible arm, wherein the first flexible arm and the second flexible arm are configured to flex toward one another to de-couple the upper connector and the base connector.

6. The light fixture of claim 1, wherein the protrusion on the upper connector is provided on a flexible flange configured to flex outwardly relative to the circular opening of the upper connector to enable the protrusion to disengage from the one of the plurality of recesses on the light fixture connector and thereby permit relative rotation between the upper connector and the light fixture connector.

7. The light fixture of claim 6, wherein the plurality of recesses are arranged around the outer perimeter of the cylindrical shape of the light fixture connector at ten degree intervals.

8. The light fixture of claim 1, wherein the upper connector and the base connector couple together with a tool-less connection system.

9. The light fixture of claim 1, wherein the upper connector comprises a flexible arm connected to the upper connector and extending from a bottom of the upper connector and angling towards an upper end of the upper connector, the flexible arm comprising a protrusion between a proximal end and a distal end of the flexible arm such that the protrusion retracts when the flexible arm is in a flexed state.

10. The light fixture of claim 9, wherein the base connector comprises a socket adapted to receive the bottom of the upper connector and a recess in a wall of the socket, the recess configured to couple with the protrusion such that when the flexible arm is in the flexed state the protrusion is withdrawn from the recess and when the flexible arm returns to an equilibrium state the protrusion engages with the recess to secure the upper connector and the base connector together.

11. A light fixture comprising:

a light module comprising a light source adapted to emit light generated by the light source, the light module comprising an electrical connection to receive electrical power for the light source;

a rotatable mount comprising:

a light fixture connector adapted to couple to the light module at a first end of the light module, the light fixture connector having a cylindrical shape with a plurality of recesses arranged around an outer perimeter of the cylindrical shape;

an upper connector defining a circular opening adapted to receive the cylindrical shape of the light fixture connector, the upper connector further comprising a protrusion that extends into the circular opening that is adapted to engage with one of the plurality of recesses on the light fixture connector; and a base connector adapted to couple to a supporting structure, the upper connector adapted to couple to the base connector with a tool-less connection system to mount the light module to the supporting structure.

12. The light fixture of claim 11, wherein the tool-less connection system comprises:

a flexible arm connected to the upper connector extending from a bottom of the upper connector and angling towards an upper end of the upper connector, the flexible arm comprising a protrusion between a proximal and a distal end of the flexible arm such that the protrusion retracts when the flexible arm is in a flexed state; and a socket defined by the base connector and adapted to receive the bottom of the upper connector; and a recess in a wall of the socket, the recess configured to couple with the protrusion such that when the flexible arm is in the flexed state the protrusion is withdrawn from the recess and when the flexible arm returns to an equilibrium state the protrusion engages with the recess to secure the upper connector and the base connector together.

13. The light fixture of claim 11, wherein the upper connector is adapted to couple to the base connector via a threaded connection.

14. The light fixture of claim 11, wherein the plurality of recesses are arranged around the outer perimeter of the cylindrical shape of the light fixture connector at ten degree intervals.

15. The light fixture of claim 11, wherein the light fixture connector and the upper connector are adapted to rotate relative to each other through a range of rotation of at least one hundred and sixty degrees.

16. The light fixture of claim 11, wherein the base connector is configured to affix to an architectural extrusion.

17. The light fixture of claim 16, wherein the base connector comprises an engagement flange at a first end of the base connector adapted to interface with a lip of the architectural extrusion and a slot at a second end thereof through which a threaded connector is driven to secure the base connector to the architectural extrusion.

18. The light fixture of claim 11, wherein the upper connector comprises a first protrusion having a first angled surface and the base connector comprises a flexible arm having a second protrusion with a second angled surface, the first angled surface and the second angled surface configured to engage and flex the flexible arm as the upper connector and the base connector are coupled together, wherein the flexible arm is configured to return to an equilibrium state when the upper connector is fully coupled with the base connector.

19. The light fixture of claim 18, wherein the first protrusion of the upper connector comprises a first locking surface and the second protrusion of the flexible arm comprises a second locking surface such that, when the upper connector and the base connector are fully coupled together, the first locking surface abuts the second locking surface.

20. The light fixture of claim 18, wherein the flexible arm is a first flexible arm and the base connector further comprises a second flexible arm, wherein the first flexible arm and the second flexible arm are configured to flex toward one another to de-couple the upper connector and the base connector.

21. A rotatable mount for a fixture, comprising:

a fixture connector having a cylindrical shape with a plurality of recesses arranged around an outer perimeter of the cylindrical shape, the fixture connector adapted to couple to an end of the fixture and enable an electrical connection to the fixture through a center of the cylindrical shape;

an upper connector defining a circular opening adapted to receive the cylindrical shape of the fixture connector, the upper connector further comprising a protrusion that extends into the circular opening and that is adapted to engage with one of the plurality of recesses on the fixture connector; and a base connector adapted to releasably couple with the upper connector to secure the upper connector to a supporting structure.

22. The rotatable mount of claim 21, wherein the upper connector comprises a flexible arm with the protrusion positioned at an end thereof, the flexible arm configured to flex to enable rotation of the fixture connector.

23. The rotatable mount of claim 21, wherein the upper connector comprises a first protrusion having a first angled surface and the base connector comprises a flexible arm having a second protrusion with a second angled surface, the first angled surface and second angled surface configured to engage and flex the flexible arm as the upper connector and the base connector are brought together, the flexible arm configured to return to an unflexed position when the upper connector is fully coupled with the base connector.

24. The rotatable mount of claim 21, wherein the upper connector and the base connector releasably couple together through a tool-less connection system, the tool-less connection system comprising:

a flexible arm connected to the upper connector extending from a bottom of the upper connector and angling towards an upper end of the upper connector, the flexible arm comprising a protrusion between a proximal and a distal end of the flexible arm such that the protrusion is retracted when the flexible arm is in a flexed state; and a socket defined by the base connector adapted to receive the bottom of the upper connector; and a recess in a wall of the socket, the recess configured to interface with the protrusion such that when the flexible arm is in the flexed state the protrusion is withdrawn from the recess and when the flexible arm is in an equilibrium state the protrusion engages with the recess to secure the upper connector and the base connector together.

25. The rotatable mount of claim 23, wherein the first protrusion of the upper connector comprises a first locking surface and the second protrusion of the flexible arm comprises a second locking surface such that, when the upper connector and the base connector are fully coupled together, the first locking surface abuts the second locking surface.

26. The rotatable mount of claim 23, wherein the flexible arm is a first flexible arm and the base connector further comprises a second flexible arm, wherein the first flexible arm and the second flexible arm are configured to flex toward one another to de-couple the upper connector and the base connector.

* * * * *